US006715158B1

(12) United States Patent
Hay

(10) Patent No.: US 6,715,158 B1
(45) Date of Patent: Apr. 6, 2004

(54) PADDED GARMENT TO PREVENT PRESSURE SORES AND OTHER INJURIES TO HIPS AND BUTTOCKS OF IMMOBILIZED PERSONS

(76) Inventor: Carl M. Hay, 27810 SE. McMinn Rd., Eagle Creek, OR (US) 97022

( * ) Notice: Subject to any disclaimer, the term of this patent is extended or adjusted under 35 U.S.C. 154(b) by 0 days.

(21) Appl. No.: 09/716,396

(22) Filed: Nov. 20, 2000

(51) Int. Cl.[7] ..... A41D 13/00
(52) U.S. Cl. ..... 2/456; 2/238
(58) Field of Search ..... 2/456, 267, 455, 2/22, 24, 465, 467, 227, 228, 238, 403, 404, 406, 407

(56) References Cited

U.S. PATENT DOCUMENTS 2,516,598 A * 7/1950 Selkirk ..... 2/455
3,909,847 A * 10/1975 Holt et al. ..... 128/79
4,462,115 A * 7/1984 Calson et al. ..... 2/455
4,807,301 A * 2/1989 Ferber ..... 2/267
4,894,867 A * 1/1990 Ceravolo et al. ..... 2/238
4,945,571 A * 8/1990 Calvert ..... 2/455
4,969,216 A * 11/1990 Guelli ..... 2/400
5,551,082 A * 9/1996 Stewart et al. ..... 2/456

* cited by examiner

*Primary Examiner*—Tejash Patel

(57) ABSTRACT

The present invention is a padded garment covering the lower torso and upper legs of paraplegics, who have lost not only control of their legs but any sensation of pain, said garments providing protection against bruises and abrasions caused by sliding about on floors, collisions with edges and corners, and/or other activities involved in moving about, the padding of said garment having a resilient core resistent to complete collapse and covered with a surface resistent to puncture or wear by the described activities and devoid of seams, fasteners, and other protrusions which could cause injury by chafing, said garment capable of conforming to any of several body positions.

8 Claims, 1 Drawing Sheet

PADDED GARMENT TO PREVENT PRESSURE SORES AND OTHER INJURIES TO HIPS AND BUTTOCKS OF IMMOBILIZED PERSONS

The present invention relates generally to padded protective garments and, more specifically, to a padded garment for use by persons who must spend much of their time sitting or lying in one position, in a wheelchair, bed, etc.

BACKGROUND OF THE INVENTION

Persons who are confined to wheelchairs or beds for prolonged periods are subject to "bed sores" or, more accurately, "pressure sores", which occur due to the breakdown of body tissues which are pressed between bony protruberances of the body and the relatively unyielding surfaces upon which they sit or lay. Particularly is this true where disease or injury has caused muscle atrophy. Healthy strong muscles provide an environment, or "background", against which the blood vessels push, and when this is gone, the blood vessels themselves atrophy, causing decreased blood supply to these tissues. This is one of the consequences of spinal cord or central nervous system disease or injuries, in addition to the loss of mobility.

Common sites of such sores are the hips or buttocks, caused by restricted circulation as well as compression of tissue between ilia, ischia or coccyx bones, and seats or mattresses. Severe medical problems can result when one who is helpless and confined to wheelchair or bed is left unattended for extended periods.

Persons with such immobility, including those who have lost the use of and, often the sensation in, their lower body, particularly their legs, are especially prone to suffer from this problem. Although pads for wheelchairs are available and effective for many purposes, and are widely used, they are not easily transferred from wheelchair to automobile, sofa, chair or, more commonly, to floor, for use when sitting thereon. The floor is a favorite place for those who wish to be as active as possible, some of whom use it as a place of work, recreation or even relaxation.

It is estimated that more than two-thirds of pressure sores suffered by wheelchair-bound individuals occur during the time they are not in their wheelchairs. Partially, this is because it is difficult and awkward for such a person to move between the floor and a wheelchair, so they tend to stay in one place or the other. Also, however, it is inconvenient and sometimes ineffective to move a cushioning pad between wheelchair and floor, and to keep it in place when moving about on the floor.

Most paraplegics use their arms to propel themselves about from place to place on the floor, particularly if they have developed substantial upper-body strength, and especially if they live alone, where they have control over their environment.

These activities, combined with frequent slidings about, can cause pressure and abrasion sores and, sometimes, bruises or even lacerations from colliding with walls, corners, furniture, and other solid obstacles found everywhere in the average dwelling. These hazards are especially critical because of the lack of sensation in lower body parts which many persons have; even if they suffer an injury, they may be unaware of it until it has become infected. Minor collisions during normal daily activities, i.e., bumping into table legs, stubbing a toe, etc., can cause injuries which can deteriorate into serious medical problems if continually irritated by the same activities, and can have adverse health consequences. The skin of a person suffering from the kind of disabilities described herein can become so vulnerable to breakdown, that constant pressure or abrasion even by clothing seams can cause injury. Consequently, prevention becomes very important.

No references have been found which deal with the range of these very special needs which are substantially ameliorated by the present invention. The lack of sensation due to spinal cord injury makes the problem of adapting existing garments especially difficult, since seams, buckles, or other fasteners can themselves cause the very problems sought to be avoided by protective garments. The fact that these very special needs still exist, in the face of the increasing number of persons having them, indicates that the shortcomings of the references now to be discussed have not been sufficiently obvious to those skilled in the art for them to be adapted to the purposes of the present invention.

The following references are all U.S. patents which disclose protective clothing intended primarily for athletes. None of these references solve the problems solved by the present invention, nor do they suggest any solutions.

Selkirk U.S. Pat. No. 2,516,598 discloses a protective garment for use by baseball players during practice. It is designed to fit over a regular player's uniform and provide protection of both person and clothing during sliding practice.

Holt et al U.S. Pat. No. 3,909,847 discloses a protector intended primarily for female athletes, designed to protect the pelvic regions as well as the hips and tailbone of the wearer.

Carlson et al U.S. Pat. No. 4,462,115 discloses protector panties having pads for protecting female athletes from injury by contact with the floor during competition.

Ferber U.S. Pat. No. 4,807,301 discloses a protector garment in the form of a wrap-around girdle having pockets therein for holding removable pads, and intended to protect the wearer against hip injuries from falling.

Cervalo et al U.S. Pat. No. 4,894,867 discloses protector briefs for protecting wearers against injuries which might be suffered during contact sports.

Guelii U.S. Pat. No. 4,969,216 discloses protector underwear in the form of jockey shorts, with pads incorporated into the seat and crotch, primarily to protect the wearer from discomfort during extended sitting. It is also stated to be effective when worn during sports activities.

Calvert U.S. Pat. No. 4,945,571 discloses a water-filled cushion which can be adapted to a number of uses to increase the comfort of users during various kinds of physical activities.

Gilford et al U.S. Pat. No. 5,052,052 discloses a suit intended for use by skaters, which contains multiple pockets adapted to hold replaceable pads located at strategic areas to protect against injury from falling.

Llorens U.S. Pat. No. 5,103,505 discloses comfort pants containing soft resilient pads, located where a wearer's buttocks contact a seat, intended to provide cushioning for persons who must sit for long periods of time on hard flat surfaces. Llorens does not provide the physically extensive protection of the present invention.

Ross U.S. Pat. No. 5,134,726 discloses sports pants with pockets located at least at the hip, knee, and groin areas so that replaceable pads can be inserted therein to protect a wearer against injury from contact sports.

A pad manufactured by Jay Medical, Ltd. of Boulder, Colo. and designed for use by paraplegics, is advertised and illustrated on page 9 of the March/April, 1993 issue of Sports'n Spokes (S'NS) magazine. It is a bucket-shaped cushion to cradle the buttocks, which fastens over the clothing of a wearer, at the waist and around each leg at the groin. Tests indicate that it catches on projecting objects in the environment and does not remain fixed in position in the range of uses of the present invention. There is no indication that a patent is issued or pending thereon.

SUMMARY OF THE PRESENT INVENTION

The present invention is a padding which can be incorporated into a garment or worn between inner and outer garments, and a garment incorporating such padding. It preferably extends from just below the belt-line to mid-thigh of a wearer and extends around the posterior of a wearer, so as to cushion the ischia bones thereof. Preferably, it is molded to conform to a sitting or recumbent posture. The padding is covered with fabric or other material, selected according to the use intended:

- if a wearer spends a great deal of time on the floor, sliding from place to place, the covering should have, preferably, abrasion-resistant qualities and a surface with a low coefficient of friction. The same considerations are important for a wearer who must spend substantial time in bed, to ease the effort of turning from side to side therein; and
- if a wearer spends most of the time in a wheel-chair, the covering preferably should be wear-resistant but have a moderate or higher coefficient of friction, to prevent him from sliding about when performing vigorous actions with his arms.

The padded garment is intended for use by those persons who, because of a variety of circumstances, must spend a great deal of their time lying in bed, or sitting, particularly in a wheelchair. As is well known, such persons often develop "bed-sores", or "pressure-sores", because of the restricted blood circulation described hereinbefore.

Paraplegics and other persons who have lost the use of their lower body, particularly their legs, are especially prone to suffer from this problem because they must depend primarily upon wheelchairs and the like for locomotion, which are not always the most comfortable places to sit. Also, they cannot always sit on padded seats and, because they have no sensation in the affected areas, they are not aware of any discomfort which might otherwise be relieved by squirming about. It can be seen that prevention is especially important to such persons in such situations.

Consequently, many such persons who wish to be as active as possible spend a great deal of their indoor time out of their wheelchairs and on the floor, which they may use as a place of work, recreation or even relaxation. Because it is difficult and awkward to move between floor and wheelchair, many paraplegics use their arms to propel themselves about from place to place on the floor, particularly if they have developed substantial upper-body strength, and especially if they live alone, where they can control their environment.

Unfortunately, the limited blood flow which occurs in atrophied tissues, combined with the constant sliding about on the floor, can cause abrasion sores and, sometimes, bruises or even lacerations from colliding with corners, furniture, and other solid obstacles found everywhere in the average dwelling. All of these injuries can deteriorate into serious medical problems if continually irritated, and can have serious health consequences.

Further, persons without sensation and normal A muscle tone are also susceptible to the formation of "bursa", or pockets of fluid, because of too much pressure against bony areas. These bursa are prone to infection and often must be drained surgically.

The present invention is intended to alleviate these problems by providing a padded garment especially designed to reduce the incidence of injury to areas with reduced blood flow in atrophied muscles and compressed body tissue, and the resulting pressure sores, abrasions, contusions, bruises and lacerations from sliding about on the floor.

Even gardening and other outdoor activities become more inviting, possible, and safe.

The present invention comprises a garment extending from waist to mid-thigh, with resilient but firm padding associated therewith. This purpose of the padding is to spread the load and thus reduce pressure on tissues and the circulatory system, and extends from just below the waist to midthigh, and laterally substantially half-way around the upper thighs and hips, providing protection for them. The garment and padding can be integral, or the padding can be removable and replacable.

For ease of donning the garment of the present invention, it has openings on both legs from waist to midthigh, fastened by hook-and-eye closures on the external surface of the garment. No internal seams are present to cause chafing or pressure on susceptible tissues. The user lays apart these openings and sits upon the portion for covering the buttocks and back of the legs, the top inner flaps, with hook and eye fasteners on the edges of the inner surfaces, are pulled up between the legs and folded over the bottom outer flaps with matching hook-and-eye fasteners on the edges of the outer surfaces, and the fasteners are engaged.

There are several advantages to the present invention, which have not been available in combination, with previous attempts to solve this problem:

- the padding protects against sitting on seams in clothing, which can cause tissue stress and consequent lacerations;
- the padding is in place at all times, thus obviating the necessity of moving it as the user moves;
- the padding cannot easily slip out of place and expose vulnerable tissue;
- being part of the clothing, the padding is movable from place to place when the wearer moves;
- it is easy to use because it is donned with the wearer's clothing;
- the wearer is protected from embarrassment because the padding is hidden from view to others;
- in persons whose hip and buttock muscles are atrophied, the padding serves a cosmetic function;
- the padding can be adapted to cushion almost any bony part of the body.

DETAILED DESCRIPTION OF THE PRESENT INVENTION

Figure 1:
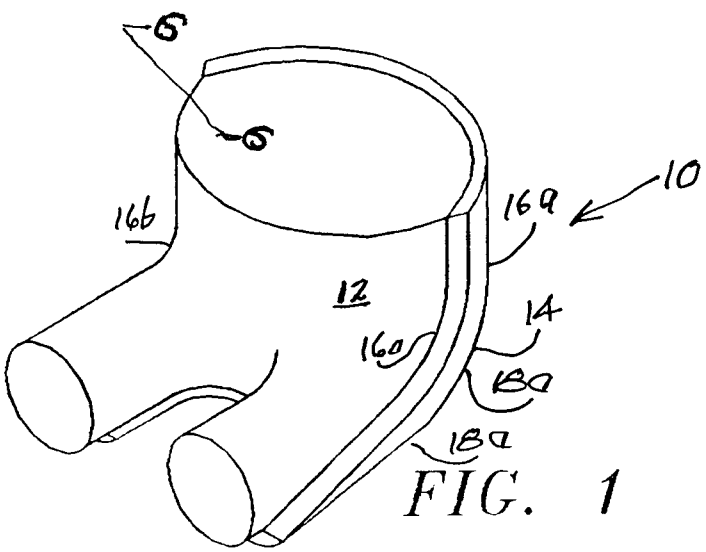
FIG. 1 is a stylized perspective view of the garment of the present invention with the padding, shaped to accomodate a sitting posture, affixed thereto.
Figure 3:
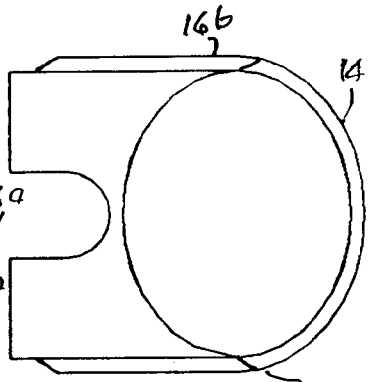
FIG. 3 is a view of the garment from above FIG. 1.
Figure 5:
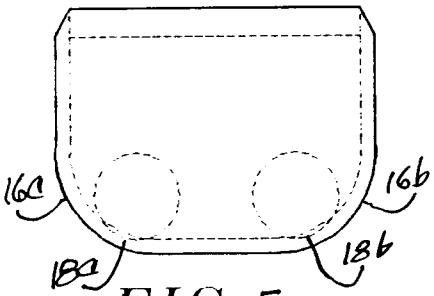
FIG. 5 is a view from the rear of FIG. 1.
Figure 4:
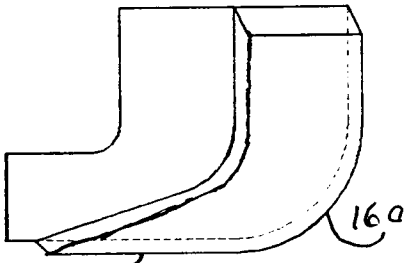
FIG. 4 is a view from the left side of FIG. 1, the right side being a mirror image thereof.

Present invention 10 is comprised of garment 12 having shaped pad 14 located substantially on the posterior thereof, as disclosed in FIGS. 3–5. Pad 14 can be shaped to any of several postures, as desired, without departing from the spirit or intent of the invention. It extends laterally, partially circumferentially, substantially around the hips 16*a*, 16*b* and buttocks 18*a*, 18*b* of the wearer, providing protection thereto. This is important where the ilium, ischium, and coccyx bones are prominent under the flesh. Pad 14 also extends along posterior surface 20*a*, 20*b* of the legs, narrowing in width—circumferentially—to approximately mid-thigh, as disclosed.

Pad 14 has bevel 22 at the edges thereof, making it easier to don clothing over the garment and padding, so that it does not form a ridge which could cause irritation to sensitive tissues.

Pad 14 is formed of a resilient flexible material, such as foamed neoprene rubber or the like, with fabric bonded to both surfaces thereof. Such material is used in wet suits used by surfers, swimmers and snorkelers in cold marine environments. The material is preferably of a density which prevents it from being completely compressed so that it will give protection against sharp corners, edges or points, and will spread an impact therefrom over a substantial area. The material of pad 14 has preferably sufficient elasticity and flexibility that changing positions does not cause bunching or wrinkling sufficient to cause stressing of tissues having a lack of sensation, but it should have sufficient "memory" that it assumes said molded shape when unrestrained by the posture of the wearer. It preferably should be rip- and tear-resistant.

Preferably, padding 14 should dissipate body heat and resist absorption of body fluids.

For maximum protection, padding 14 needs to be held fixedly in place on garment 12 so that sliding on the floor, shifting positions in bed or wheelchair, or other movements that would tend to place lateral pressure on padding 14 will not pull it out of position. This fixing in place can be by any of several well-known retention means, such as VELCRO fastener or other hook and loop fasteners appropriately placed, by external strap-on pad, by fitted pockets in garment 12, in a separate attachable bag, etc.

Figure 2:
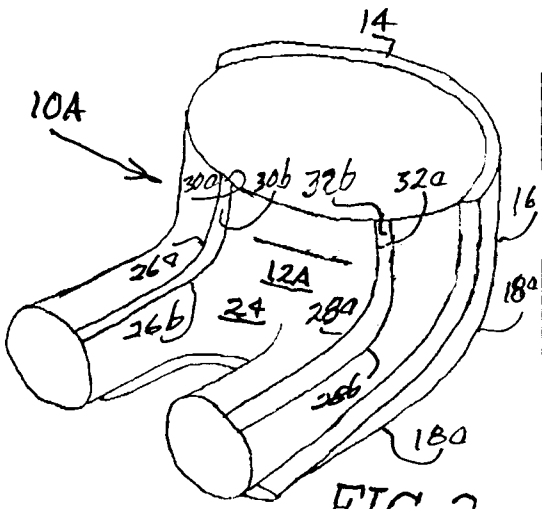
FIG. 2 is a stylized perspective view of the preferred embodiment of the present invention, disclosing the openings on each leg, with hook-and-eye fasteners on the edges thereof.
Figure 6:
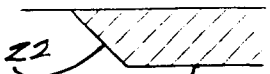
FIG. 6 is a view in cross-section along the lines 6—6 in FIG. 1 disclosing the beveled edge treatment of the padding.

The preferred embodiment disclosed in FIG. 2 differs from the foregoing description in that front 24 of garment 12A can be opened on each leg portion from waist to mid-thigh. The edges 26*a* of the right opening and 28*a* of the left opening, respectively, on the inner surfaces 30*a* and 32*a* thereof, also respectively, are lined with hook-and-eye closures, and the edges 30*b* and 32*b* of said openings on the outer surfaces 32*b* and 32*b*, respectively, have matching closures thereon. The inner surfaces of the garment are thus free of ridges and/or seams which could cause pressure or irritation of underlying tissues.

The descriptions of FIGS. 3–6 will apply to FIG. 2, also.

It will be recognized by those skilled in the art that several changes can be made in the disclosed invention without departing from the spirit or intent thereof.

The terms and expressions which have been employed in the foregoing specification are used therein as terms of description and not of limitation, and there is no intention, in the use of such terms and expressions, of excluding equivalents of the features shown and described, or portions thereof, it being recognized that the scope of the invention is defined and limited only by the claims which follow.

What I claim as my invention is:

1. A garment for protecting the tissues over the ilia, ischia, and coccyx bones of a wearer having central nervous system injuries and for reducing the incidence of pressure sores, abrasions, impact bruises, and the like injuries to said wearer, said garment hugging the hips and posterior of said wearer from the waist to mid-thigh thereof, COMPRISING: fabric-covered shaped padding molded to conform to a sitting posture of a wearer, and extending laterally and partially circumferentially around said waist and thighs thereof, said padding being smooth on the internal surface thereof and having beveled edges on the external surface thereof.

2. A garment for protecting the tissues over the ilia, ischia, and coccyx bones of a wearer having central nervous system injuries and for reducing the incidence of pressure sores, abrasions, impact bruises, and the like injuries to said wearer, said garment hugging the hips and posterior of said wearer from the waist to mid-thigh thereof, COMPRISING: fabric-covered shaped padding molded to conform to a recumbent posture of a wearer, and extending laterally and partially circumferentially around said waist and thighs thereof, said padding being smooth on the internal surface thereof and having beveled edges on the external surface thereof.

3. The protective garment of claims 1 or 2, wherein said retention means comprises hook and loop fasteners for maintaining said shaped padding in fixed relationship thereto.

4. The protective garment of claims 1 or 2, wherein said padding is formed of foamed neoprene rubber.

5. The protective garment of claims 1, or 2, wherein said padding dissipates body heat and resists absorption of body fluids.

6. The protective garment of claims 1 or 2, wherein said garment has retention means on the external surface thereof for retaining said padding in fixed relationship to said waist and thighs of said wearer, said padding COMPRISING: a resilient and flexible material being wear- and tear-resistant and having shape memory and a density which prevents complete compression, and having fabric bonded to both surfaces thereof.

7. The protective garment of claim 3, wherein said padding is formed of foamed neoprene rubber.

8. The protective garment of claim 4, wherein said padding dissipates body heat and resists absorption of body fluids.

* * * * *